US005388877A

United States Patent [19]

Wenk

[11] Patent Number: 5,388,877

[45] Date of Patent: Feb. 14, 1995

[54] HUNTING BOW RETRIEVER

[76] Inventor: Carl J. Wenk, Rte. 3, Polk Rd., Hart, Mich. 49420

[21] Appl. No.: 116,708

[22] Filed: Sep. 7, 1993

[51] Int. Cl.[6] ..... B65H 75/40; B66C 1/10

[52] U.S. Cl. ..... 294/1.1; 294/82.11; 242/395.1; 224/162

[58] Field of Search ..... 294/1.1, 19.2, 26, 66.1, 294/82.1, 82.11; 242/84.8, 86, 96, 99; 224/162, 268, 916

[56] References Cited

U.S. PATENT DOCUMENTS

| | | | |
|---|---|---|---|
| D. 308,716 | 6/1990 | Erickson . | |
| 1,977,863 | 10/1934 | Simpson | 242/84.8 |
| 3,141,696 | 7/1964 | Nau | 294/19.2 |
| 3,438,595 | 4/1969 | Brown et al. . | |
| 3,756,644 | 9/1973 | Rydberg | 294/19.2 X |
| 3,888,010 | 6/1975 | Hyde et al. . | |
| 3,907,236 | 9/1975 | Sim, Jr. . | |
| 4,121,785 | 10/1978 | Quenot | 242/99 X |
| 4,195,794 | 4/1980 | Ricci et al. | 242/99 |
| 4,272,036 | 6/1981 | Watermann | 242/96 |
| 4,286,387 | 9/1981 | Di Diego | 242/84.8 |
| 4,416,351 | 11/1983 | Geurtsen . | |
| 4,828,307 | 5/1989 | Sokol et al. . | |

FOREIGN PATENT DOCUMENTS

| | | | |
|---|---|---|---|
| 2535040 | 4/1984 | France | 224/162 |

OTHER PUBLICATIONS

Gander Mountain Catalog, Fall 1993, p. 200.

*Primary Examiner*—Dean J. Kramer

*Attorney, Agent, or Firm*—Waters & Morse

[57] ABSTRACT

A hunting bow retrieval device is releasably engagable with a hunting bow to allow a treebound hunter to raise and lower the hunting bow to the hunting position. The hunting bow retriever comprises a reel mounted in an enclosed palm-sized casing and a line wound on the reel and extending out of the casing. The line has an open hook on the end that permits remote release of the bow. The casing is attached to a hunter with a belt clip. A foldable handle assembly engages the reel to implement rotational movement. A thumb brake allows a controlled release of said tension member from the wound position.

7 Claims, 2 Drawing Sheets

HUNTING BOW RETRIEVER

BACKGROUND OF THE INVENTION

This invention relates to an apparatus for releasably engaging an object from an elevated position. More particularly this invention relates to an apparatus for raising and lowering a hunting bow to and from a hunting position in a tree.

Hunters have enjoyed hunting with a bow and arrow for centuries. In the course of hunting with the bow and arrow, it is often advantageous for the hunter to position himself in a tree or other elevated position to enhance his prospects for catching his prey.

Trees are difficult to climb, often requiring the hunter to use both hands and both feet to attain the desired position. This presents the difficulty of effectively carrying the hunter's equipment such as the hunting bow. Accordingly, there is a need for a cost effective apparatus for assisting in the raising and lowering of a hunting bow to and from an elevated surface such as a tree stand or tree branch.

Various attempts have been made to assist the hunter in the raising and lowering of his hunting bow. In one example, a rope with a clip attached at an end is carried with the hunter. The hunter clips one end to the bow and then climbs the tree, gradually letting out the rope as he climbs. The rope is then retrieved when the hunter is situated in his elevated station. The bow is lowered to the ground and then the rope is dropped when the hunter returns to the ground. This apparatus, while cheap, has the disadvantage that the cord becomes easily tangled and catches on branches and is difficult to feed out as the hunter is climbing the tree. Storage of the rope is also a problem.

Other attempts to assist the hunter in this regard have used a flat strap in conjunction with a reel. A strap is stronger than a rope and can be used to raise the hunter's other equipment such as a backpack. However, the advantages of a strap are generally not utilized. Hunters rarely carry more than a bow up the tree, choosing instead to leave their supplies on the ground. Strap devices also are cumbersome for a hunter since he frequently must carry the device in his hand while he climbs the tree. The strap devices of the prior art also do not provide for efficient winding or a controlled unwinding of the strap from the reel. A strap must be wound flat requiring greater control and attention by the hunter. Additionally, straps are not economical since the materials involved are costly.

Most devices for raising or lowering a hunting bow include a clip which must be manually disengaged from the respective gear. While a clip provides stability, it also presents a serious limitation during use of the device to lower his bow back to the ground. The hunter cannot unclip his gear from a remote location. Thus, after a hunter who is positioned in a tree branch lowers his gear to the ground, he must either manipulate his reel about numerous branches during his descent or throw his reel to the ground. This is undesirable because it is difficult to hold on to a reel while climbing and the strap can become tangled in the branches during the descent. Throwing the reel from a tree branch is also disadvantageous because the reel can break and the strap can again become tangled in branches. Additionally, ropes and straps of the prior art generally incorporate metallic components which make a "clink" sound upon contact. The particular frequency of this sound has the tendency of alerting prey to the presence of the hunter and thus reducing his chances for effective hunting.

SUMMARY OF THE INVENTION

The present invention is a hunting bow retrieval device which can be carried on a hunter's belt and is easily engaged and disengaged from a hunting bow. The disengagement may be performed from a remote elevated position. The retrieval device comprises a cord or like elongated tension member mounted on a reel inside a protective casing. The outer casing fits within the palm of the hand or can be clipped on a belt for hands free use. The casing includes a pair of side members which form an interior recess. The reel is at least partially mounted within the interior recess and is confined to rotational movement therein. The side members constrain the reel to rotational movement in the casing. A reel handle assembly passes through at least one of said side members to engage the reel. It includes a winding means for implementing the rotational movement of the reel. An angular open hook is affixed at an end of the tension member to releasably engage the hunting bow. The hook can be released from the bow after the bow has been lowered to the ground. A braking means allows a controlled release of said tension member from the wound position.

DETAILED DESCRIPTION OF THE PREFERRED EMBODIMENT

Figure 1:
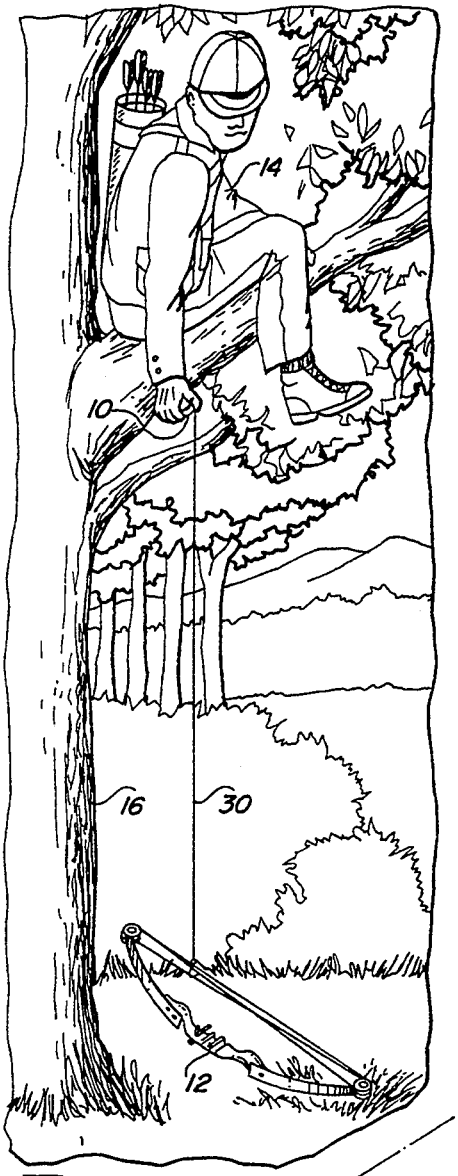
FIG. 1 is a pictorial representation of the present invention in actual use.

Referring to the drawings and in particular to FIG. 1, a hunting bow retriever 10 is shown held by hunter 14 sitting in tree 16. Hunter 14 is shown lowering bow 12 to the ground in a controlled manner. While hunter 14 is perched in tree 16, he may disengage hunting bow retriever 10 from bow 12 and wind up line 30 before making his descent. Thus, hunter 14 does not have to drop bow retriever 10 to the ground or manipulate line 30 during his descent. The added noise from these activities may scare game in the immediate vicinity.

Hunting bow retriever 10 is also used for raising bow 12 into a hunting position. Hunter 14 first sets bow 12 against the trunk of tree 16. With his hunting bow retriever 10 attached to his belt, hunter 14 may then use both hands and both feet to scale tree 16. After reaching a secured hunting position, hunter 14 lowers line 30 from bow retriever 10, engages bow 12, then raises bow 12 to his position. Alternatively, the hunter can hook the hook or tie the line to his bow while he climbs the tree. With the bow retriever hooked on his belt line is automatically fed out of the bow retriever as he climbs. The line can be retracted into the bow retriever after the hunter is stationed in the tree in order to raise the bow. In either case, hunter 14 is relieved from the burden of carrying bow 12 or holding a reel in his hands during his difficult ascent.

Figure 2:
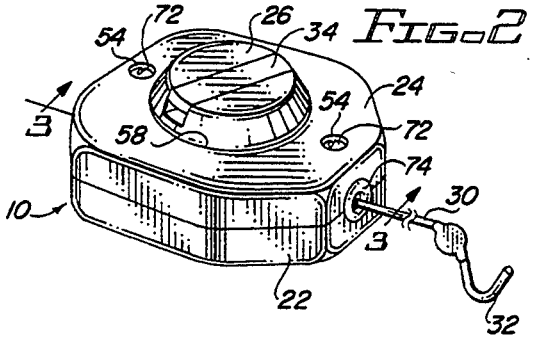
FIG. 2 is an elevated perspective view.

FIG. 2 shows a perspective view of hunting bow retriever 10. Hunting bow retriever 10 is shown with base 22 connected to cover 24. Thumb brake 26 is shown protruding from thumb brake exit hole 58 in the center of cover 24. Thumb brake 26 includes foldable handle 34 which opens to assist the operator in reeling in line 30. Foldable handle 34 closes to provide an increased surface area for thumb brake 26. Thumb brake 26 is so named since hunter 14 may controllably lower hunting bow 12 by providing a frictional contact between his thumb and the flat outer surface area of thumb brake 26. Thumb brake 26 acts as a manually operated, single handled clutch which allows hunter 14 to firmly grasp tree 16 with his free hand. This provides increased safety for hunter 14.

Line grommet 74 is positioned at the front of hunting bow retriever 10. Line grommet 74 prevents excessive wear through contact between line 30, cover 24 and base 22. Angle hook 32 is attached to the end of line 30 and is configured to engage hunting bow 12. Angle hook 32 is preferably dipped in a commercially available rubber compound. The rubber compound serves the purposes of binding the end of line 30 to angle hook 32 and preventing corrosion. The rubber compound also prevents the characteristic metallic sound from occurring during contact with a solid object. The metallic sound has the tendency of frightening animals from the vicinity. Line 30 should be of sufficient strength to enable hunter 14 to retrieve a variety of items. Preferably, line 30 is made from 150 pound test line and has a camouflage color such as green.

In further reference to cover 24, cover fitting holes 54 are disposed near the front and rear sides of hunting bow retriever 10. Fitting means 72 are shown positioned within cover fitting holes 54 and 56 to firmly secure cover 24 to base 22. While cover 24 and base 22 may be made from a variety of materials, the preferred material is polypropylene.

Figure 3:
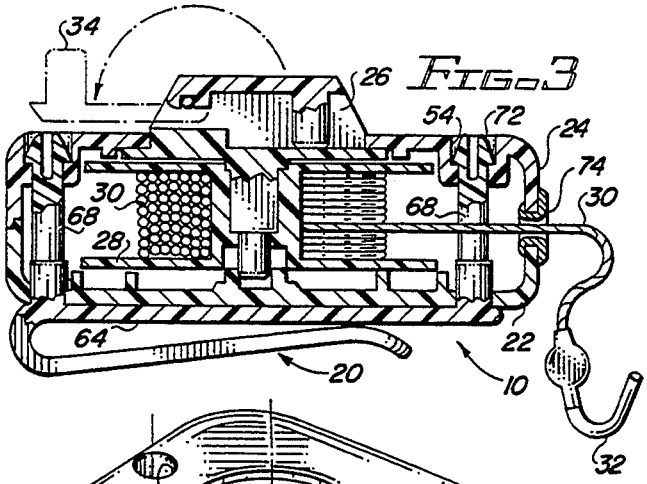
FIG. 3 is a cross-sectional view demonstrating movement of the foldable handle.

In reference to FIG. 3, a more detailed sectional view of hunting bow retriever 10 is shown. In particular, foldable handle 34 is shown in its open and closed position in relation to thumb brake 26. Belt clip 20 is shown in relation to base 22 and cover 24. Belt clip 20 includes a support plate 64 which is molded in continuous fashion with spring clip 66. The combined interaction of spring clip 66 with support plate 64 provides a means for fastening the hunting bow retriever 10 to the clothing of hunter 14 during storage. Belt clip 20 includes a pair of connectors 68 each respectively terminating in a spring fitting means 72. Spring fitting means 72 elastically deform as connectors 68 pass through base 22 to engage cover 24.

Figure 4:
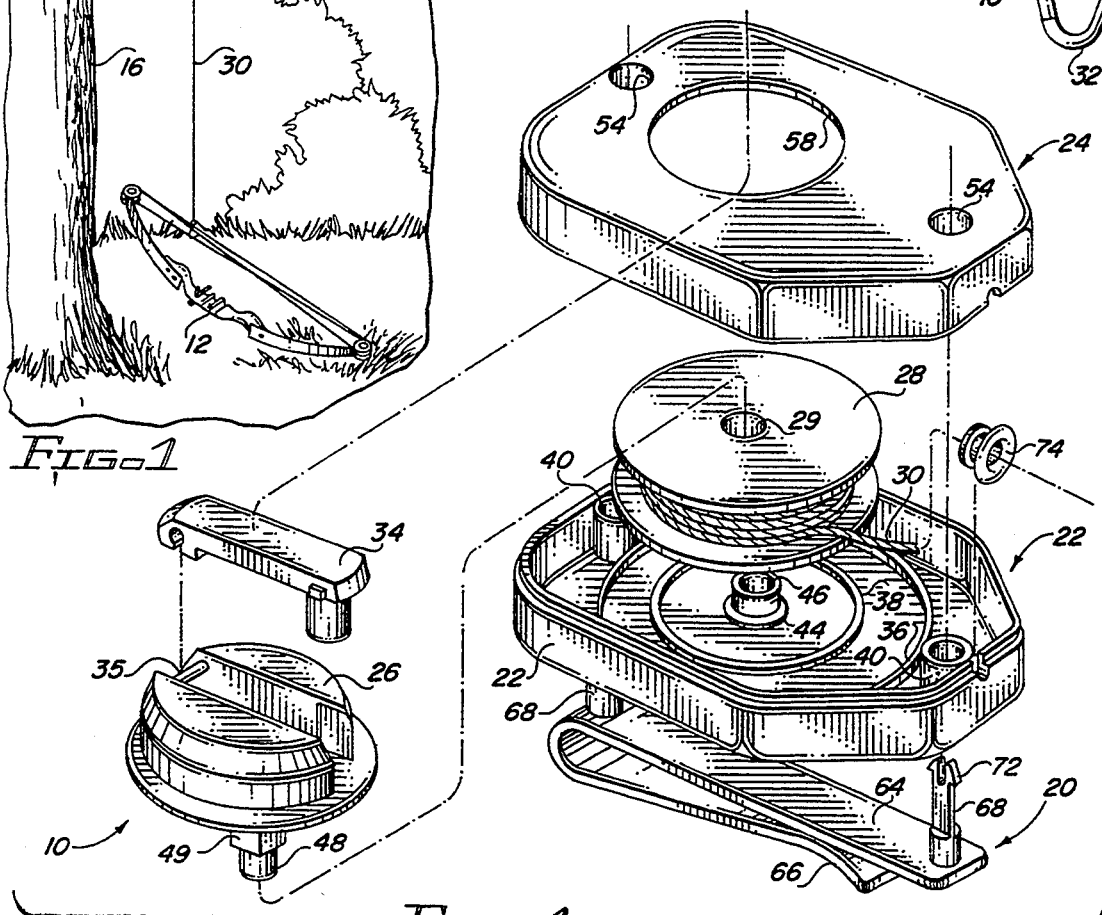
FIG. 4 is an exploded perspective view showing placement of the spool, thumb brake and belt clip.

In reference to FIG. 3 and FIG. 4, thumb brake 26 is shown in relation to spool 28 within cover 24 and base 22. Thumb brake 26 includes handle 34 which is rotatably mounted on handle pin 35. Thumb brake 26 also includes axle 48 and spool engagement means 49 which extend co-axially in a downward relation from thumb brake 26. Axle 48 rotates about axle base 46 to allow rotation of spool 28. Spool engagement means 49 extends downwardly from thumb brake 26 to provide a means for rotating spool 28. Spool engagement means 49 is rectangular in shape and configured to fit within spool receiving hole 29. Spool 28 has a receiving hole 29 which is rectangular in shape to firmly secure spool engagement means 49. Thus, thumb brake 26 and spool 28 rotate in concentric relation to one another.

Figure 5:
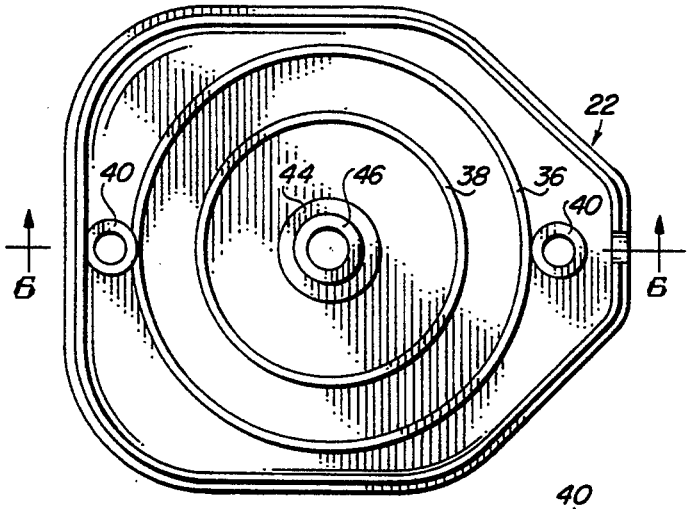
FIG. 5 is an elevated top view of the bow retriever base.
Figure 6:
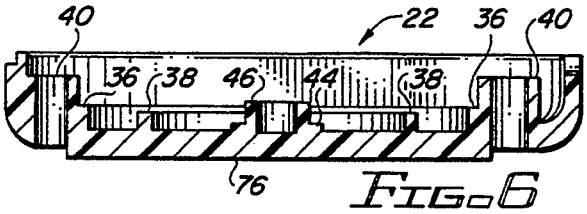
FIG. 6 is a sectional side view taken along line 5—5 of FIG. 5.

In reference to FIG. 5 and FIG. 6, base 22 is shown with axle base 46 surrounded by spool support 44. Axle base 46 provides a receptacle for insertion of axle 48 therein. Spool 28 rotates about axle base 46 and is prevented from frictional contact with base 22 through contact with spool support 44, base outer spool retention rim 36 and base inner spool retention rim 38. In reference to FIG. 6, a pair of parallel guides 76 are provided on the bottom side of base 22. Guides 76 help to align belt clip 20 in the correct relation with cover fitting holes 54 by preventing lateral movement thereof.

Figure 7:
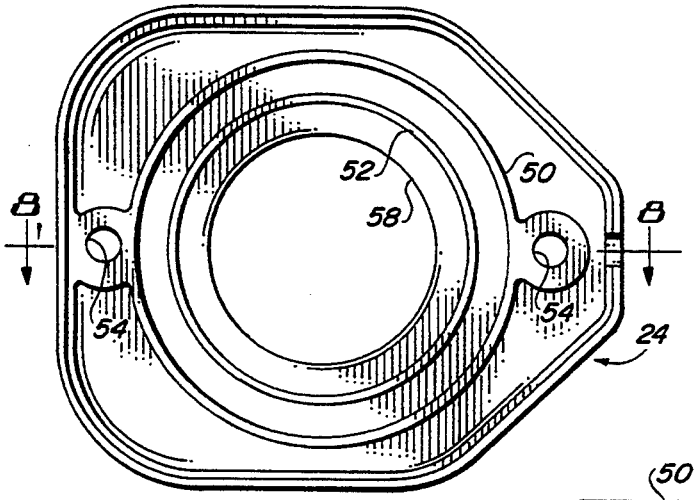
FIG. 7 is an elevated bottom view of the bow retriever cover.
Figure 8:
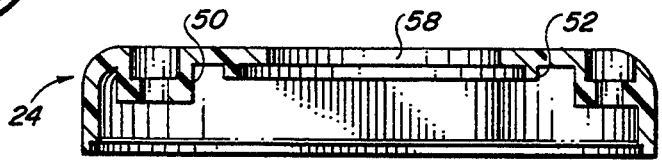
FIG. 8 is a sectional side view taken along line 7—7 of FIG. 7.
Figure 9:
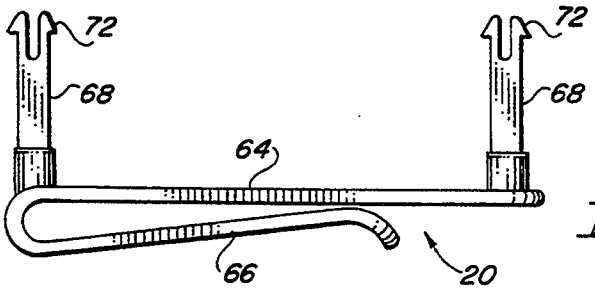
FIG. 9 is an elevated side view of the belt clip showing front and rear connectors.

In reference to FIGS. 7 and 8, cover 24 is shown with thumb brake exit hole 58 in the center thereof. Cover fitting holes 54 are disposed upon alternate sides of thumb brake exit hole 58 for retaining spring fitting means 72 therein. Cover outer spool retention rim 50 and cover inner spool retention rim 52 are concentrically disposed around thumb brake exit hole 58. Cover outer spool retention rim 50 outlines the periphery of spool 28 to retain spool 28 therein. Cover inner spool retention rim 52 prevents frictional contact of spool 28 with cover 24 and helps to retain thumb brake 26 in its proper position.

Although the preferred practice of the present invention has been described above, it will be apparent to those skilled in the art that certain variations or modifications of the invention may be made with effective results but without departing from the scope of the invention which is defined in the following claims.

I claim:

1. A hunting bow retrieval device for releasably engaging a hunting bow comprising:

an elongated tension member so configured and arranged to support the weight of a hunting bow when pulled vertically into a hunting position;

an outer casing configured to be received within the palm of the hand including a pair of side members, said side members being longitudinally engagable along respective borders thereof to form an interior recess, said side members also defining an aperture which constricts passage of said tension member therethrough;

a reel at least partially mountable within the interior recess and confined to rotational movement therein, said reel being mounted between the side members so as to restrict longitudinal or lateral movement with respect thereto, said reel including an exterior circumference, with the tension member being wound about said exterior circumference into a wound position;

a handle assembly passing through at least one of said side members to engage the reel, said handle assembly including a winding means for implementing rotational movement of said reel;

a hunting bow engagement means affixed at an end of the tension member for releasably engaging the hunting bow; said hunting bow engagement means comprising an angular hook of sufficient diameter to prevent penetration into said aperture and which is coated in a noise reducing compound; and braking means allowing a controlled release of said tension member from the wound position.

2. A hunting bow retrieval device comprising:

a hollow casing having an attachment means thereon for releasably attaching the casing to a hunter, the casing having a line opening therein that permits line to pass into and out of the casing, the line opening being positioned such that line can be fed freely downwardly from the casing when the casing is attached to the hunter;

a reel rotatably mounted in the casing in position to dispense line through the line opening, the reel having an axis of rotation transverse to the axis of the line opening;

an exterior hub positioned on the exterior of the casing and protruding through the casing into driving engagement with the reel so as to rotate with the reel;

a handle movably mounted on the exterior hub for movement between a collapsed position, wherein the handle is folded into the exterior hub, and an extended position, wherein the handle is folded outwardly from the exterior hub and provides a gripping means for rotating the reel, the handle and exterior hub presenting a generally smooth exterior braking surface without protruding obstructions when the handle is folded into its collapsed position, such that rotation of the reel can be controlled by a braking effect created by pressing a thumb against the exterior braking surface while holding the casing; and a line wound on the reel and extending through the line opening to a distal end, the distal end being attachable to a bow such that a bow can be raised and lowered from an elevated position in a tree the line having a tensile strength sufficient to support the weight of a bow.

3. A hunting bow retracting device according to claim 2 wherein the attachment means for attaching the casing to the hunter is a belt clip that fits downwardly over a belt, the belt clip being on a back side of the casing, the exterior hub portion being on a front side of the casing.

4. A hunting bow retrieval device according to claim 3 wherein when the casing is clipped to a hunter's belt, the reel is positioned in an axis that is generally horizontal and the line opening is in the bottom of the casing, such that line extends downwardly through the line opening in a line extending generally tangent to an outer peripheral surface of the reel.

5. A hunting bow retrieval device according to claim 2 wherein the casing is formed in two separable sections, that are joined together, with an open interior being formed between the sections, the casing and reel mechanisms being formed principally of plastic resin materials such that operating noise is minimized in the use of the device.

6. A hunting bow retrieval device comprising:

a hollow casing having an attachment means thereon for releasably attaching the casing to a hunter, the casing having a line opening therein that permits line to pass into and out of the casing, the line opening being positioned such that line can be fed freely downwardly from the casing when the casing is attached to the hunter;

a reel rotatably mounted in the casing in position to dispense line through the line opening, the reel having handle means positioned outside the casing for rotating the reel to retract a line mounted thereon; and a line wound on the reel and extending through the line opening to a distal end, the distal end being attachable to a bow such that a bow can be raised and lowered from an elevated position in a tree; and an open hook mounted on the distal end of the line, the hook being generally U-shaped and having an open side that faces upwardly when the distal end of the line is extended vertically downwardly from the casing, the hook fitting under a bow string for raising and lowering a bow from a tree and being remotely removable from a bow on the ground simply by lowering the hook so that the hook falls away from the bow string, whereby the bow can be released from the hook and the line retracted into the reel before a hunter descends from the tree.

7.A hunting bow retrieval device for raising and lowering a bow from an elevated position comprising an enclosed reel mechanism including a reel rotatably mounted in an open interior of a closed casing, a line being wound on the reel and having a distal end that extends through a line opening in the casing, an open, upwardly facing hook being attached to the distal end of the line, the reel having an exterior hub that is exposed on an exterior side of the casing, the hub serving as a brake by applying thumb pressure thereto as it rotates, a handle extending outwardly from the hub for rotating the reel, the handle being foldable into the hub when not in use such that the hub has a generally unobstructed outer surface that permits braking of a rotating hub by thumb pressure applied thereto.

* * * * *